United States Patent [19]

Perry et al.

[11] 4,036,382

[45] July 19, 1977

[54] BOTTLE HANDLING APPARATUS

[75] Inventors: Eric Perry; Roy T. Heath, both of Arcadia; Lee F. Rost, La Verne; Braughler Cowan, Rancho Santa Fe, all of Calif.

[73] Assignee: C & P Industries, Inc., Newport Beach, Calif.

[21] Appl. No.: 613,615

[22] Filed: Sept. 15, 1975

[51] Int. Cl.[2] ..... B65B 21/02

[52] U.S. Cl. ..... 214/313; 214/750

[58] Field of Search ..... 214/312, 313, 314, 315, 214/707, 750; 198/145

[56] References Cited

U.S. PATENT DOCUMENTS

| | | | |
|---|---|---|---|
| 1,796,119 | 3/1931 | Olson | 198/154 |
| 2,788,135 | 4/1957 | Girotti | 214/707 |
| 2,808,947 | 10/1957 | Shippy | 214/315 |
| 2,899,091 | 8/1959 | Collins | 214/313 |
| 3,035,725 | 5/1962 | Beaman et al. | 214/313 |
| 3,367,321 | 2/1968 | Bridell | 214/313 |
| 3,567,054 | 3/1971 | Emke | 214/750 |
| 3,805,420 | 4/1974 | Crum | 198/145 |
| 3,868,033 | 2/1975 | Le Duff | 214/313 |

FOREIGN PATENT DOCUMENTS

| | | | |
|---|---|---|---|
| 1,277,406 | 6/1972 | United Kingdom | 214/313 |

*Primary Examiner*—Lawrence J. Oresky

*Attorney, Agent, or Firm*—Blakely, Sokoloff, Taylor & Zafman

[57] ABSTRACT

A bottle handling apparatus for placing a bottle of water, or the like into a water cooler or water dispensing stand. The bottle is lifted from floor level then rotated in order that the neck of the bottle may engage the water inlet of the cooler.

11 Claims, 13 Drawing Figures

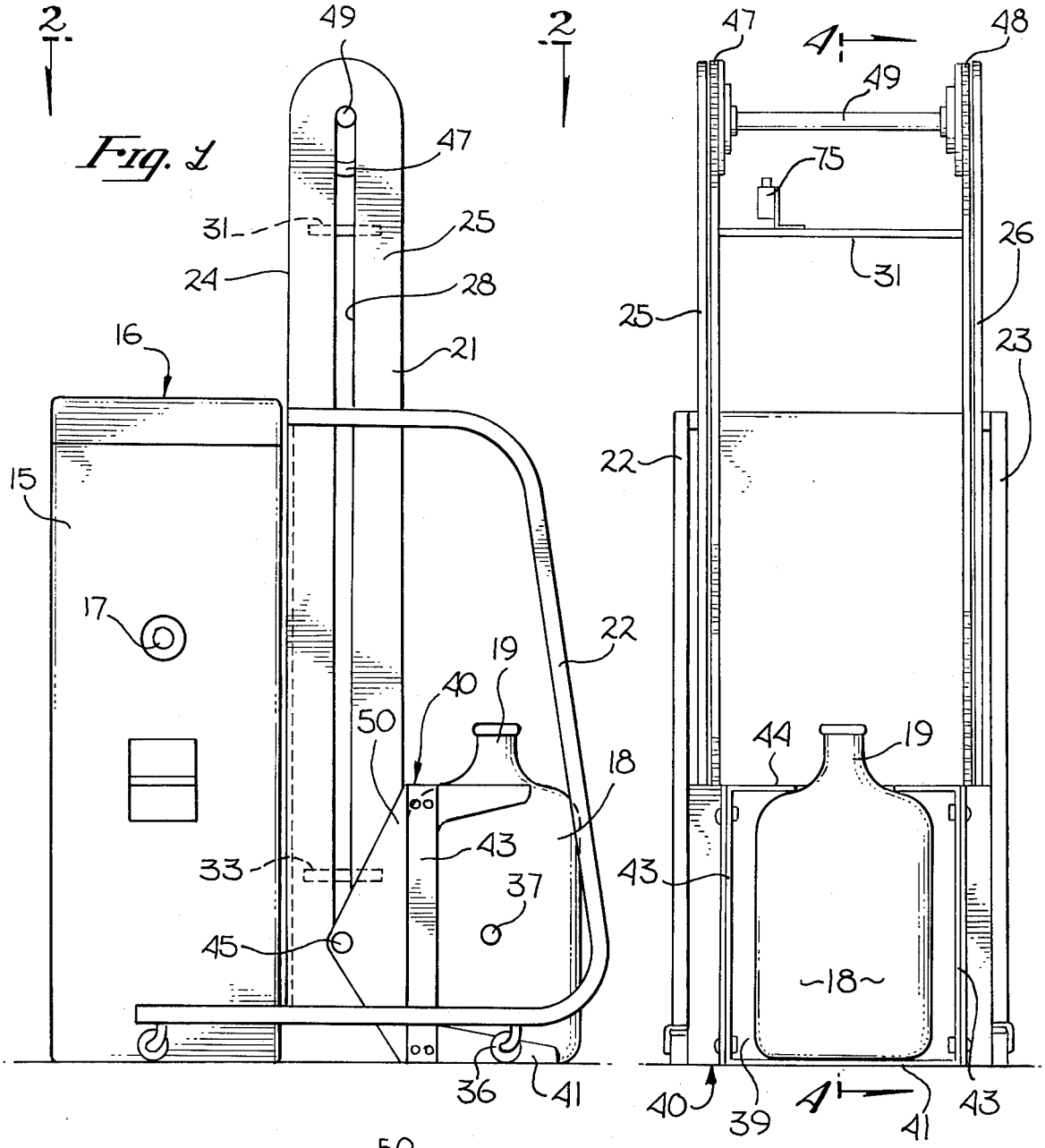
Fig. 1
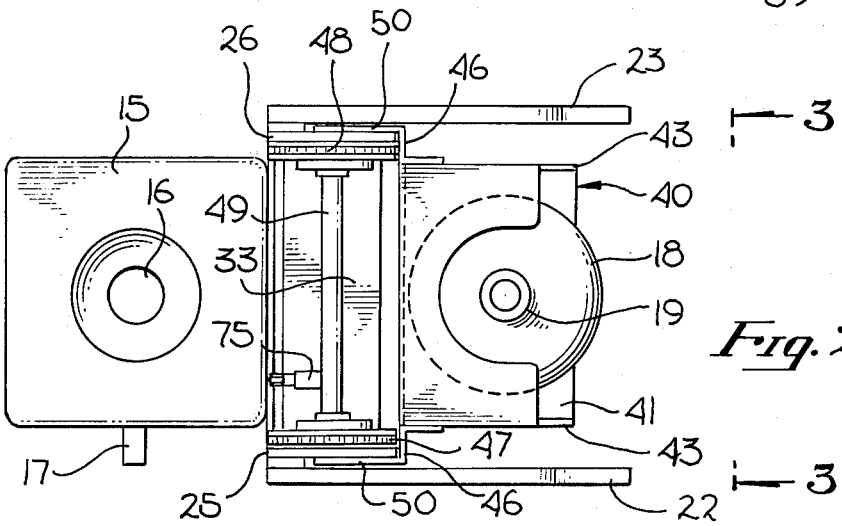
Fig. 3
Fig. 2

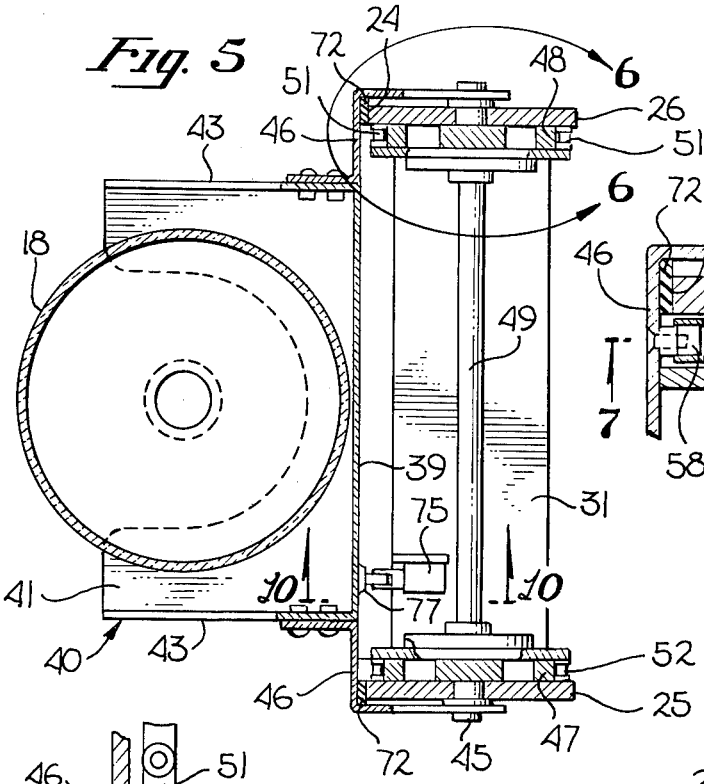
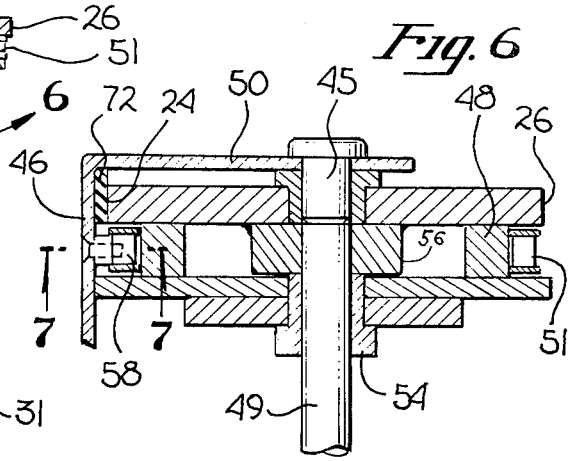
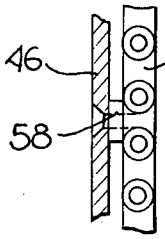
Fig. 7
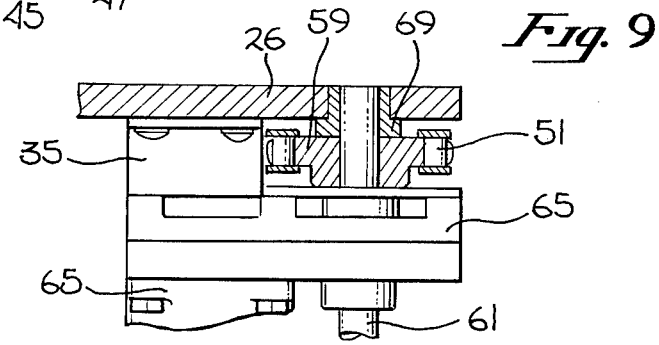
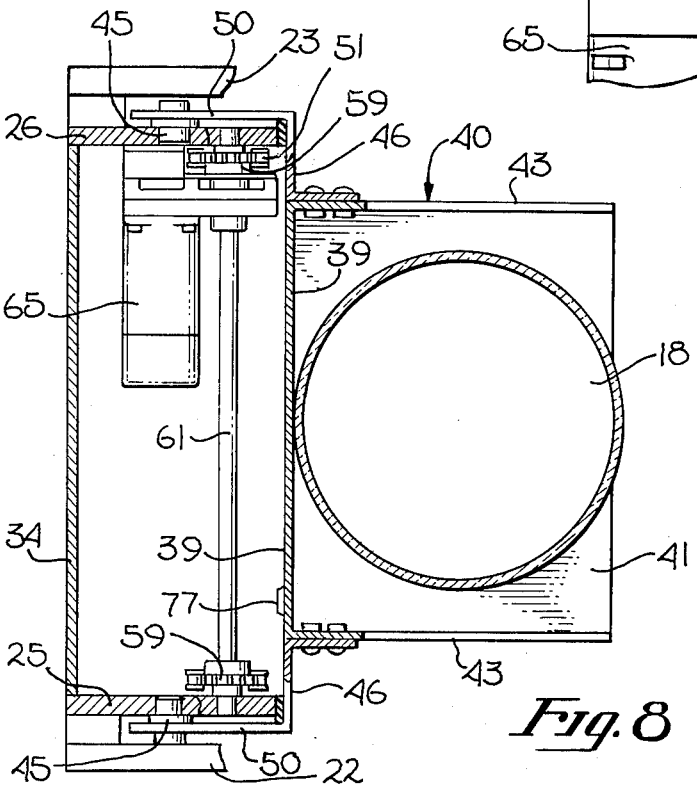
Fig. 8
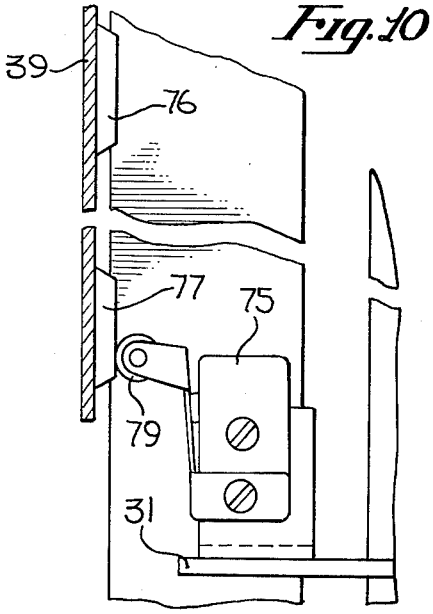

BOTTLE HANDLING APPARATUS

BACKGROUND OF THE INVENTION:

1. Field of the Invention

The invention relates to the field of bottle or container handling apparatuses.

2. Prior Art

Bottled water is often used, particularly in parts of the country where tap water contains undesirable matter, such as mineral salts, chlorine, particulate matter, etc. Typically the water is delivered in large bottles weighing approximately sixty pounds. These bottles must then be lifted, and inverted, into a water cooler, water stand, or the like. The chore of lifting the bottle and placing it inverted in a water cooler or stand is strenuous and beyond the capability of many persons desiring bottled water. Also, large bottles of water are on occasion dropped when being placed in a cooler or stand. When this occurs physical harm can result from broken glass, in addition to water damage.

There have been some attempts to provide means for lifting bottles or other containers into water coolers or the like, however, none of these prior art devices have been commercially successful for numerous reasons. One such device is shown in U.S. Pat. No. 2,019,034. This device requires a special water cooler since the water spout is coupled to the bottle prior to the time that the bottle is rotated (inverted) into a usable position. Another device is shown in U.S. Pat. No. 2,319,739, and a third device for rotating milk containers into an inverted position is shown in U.S. Pat. No. 2,139,208. In all of the above mentioned three patents, the rotation of the container into an inverted position occurs generally about the neck of the container. For this reason a large rotational force is necessary to invert the container, making such devices impractical where the bottle is manually rotated, and expensive to realize in a automatic device because of the large driving forces that are required.

Other devices for lifting and dumping containers are shown in U.S. Pat. No. 1,362,560 and 3,528,577. The devices disclosed in these patents for raising and dumping containers are relatively complicated, and involve the use of pulleys and cables. Such devices would not be practical, particularly for home and office use because of their cost and size.

As will be seen, the presently disclosed apparatus provides a relatively inexpensive means for lifting a water bottle, and rotating the bottle such that the neck of the bottle may enter a water cooler or stand. Rotation of the bottle occurs at approximately the center of gravity of the bottle thereby reducing the requirement for a high rotational force.

SUMMARY OF THE INVENTION

An apparatus for lifting and inverting a container such as a water bottle is disclosed. The apparatus is adaptable for lifting the bottle from floor level in an upright position, rotating (inverting) the bottle, and then lowering the inverted bottle into the bottle receiving inlet of a water cooler, or the like. A pair of vertical rails are disposed adjacent to the cooler on the disclosed apparatus. These rails define vertical guide slots for receiving the pins of a bottle carrier. The bottle carrier is pulled upwardly with the bottle in an upright position to the top of the guide slots, and then rotated to an inverted position on a pair of idlers disposed at the top of the guide slots. In the presently preferred embodiment, a chain drive which is coupled to the carrier by a pair of master links furnishes the driving force from a motor and gear box to lift and rotate the bottle. Automatic stops are provided to stop the bottle movement once the bottle is inverted above the water cooler so that the bottle cap may be removed prior to lowering the inverted bottle into the water cooler or stand. The center of gravity of the bottle in the bottle carrier, in the presently preferred embodiment, is positioned slightly above the pivot axis of the bottle carrier such that when rotation of the bottle occurs the weight of the bottle (and water) provide force for rotating the bottle into its inverted position. The carrier includes a braking surface which contacts the rails after the bottle has been rotated into its inverted position to insure that the bottle may be easily stopped for removal of the bottle cap.

It is an object of the present invention to provide a relatively inexpensive, compact means for raising, rotating and lowering a water bottle into a water cooler, water stand or the like.

BRIEF DESCRIPTION OF THE DRAWINGS

FIG. 1 is a general side view of the water handling apparatus of the present invention, disposed adjacent to a water cooler.

FIG. 2 is a plan view of the water handling apparatus and water cooler of FIG. 1 taken along section line 2—2 of FIG. 1.

FIG. 3 is a general frontal view of the water handling apparatus of FIGS. 1 and 2 taken along section line 3—3 of FIG. 2.

FIG. 5 is a detailed cross-sectional plan view of the water handling apparatus taken through section line 5—5 of FIG. 4.

FIG. 6 is an exploded view of the section of the apparatus shown in FIG. 5 within section line 6—6.

FIG. 7 is a partial cross-sectional side view of the bottle carrier and chain taken through section line 7—7 of FIG. 6. This view is used to illustrate the master link connecting the bottle carrier to the chain.

FIG. 8 is a detailed cross-sectional plan view taken through section line 8—8 of FIG. 4. This view is utilized to primarily illustrate the motor and gear box, and the driving sprockets used to drive the chains.

FIG. 9 is a partial detailed cross-sectional plan view illustrating a driving sprocket taken generally through section line 9—9 of FIG. 4.

FIG. 10 is a cross-sectional side view taken generally through section line 10—10 of FIG. 5. This view is used to illustrate the engagement of a detent on the bottle carrier with a switch.

Figure 4:
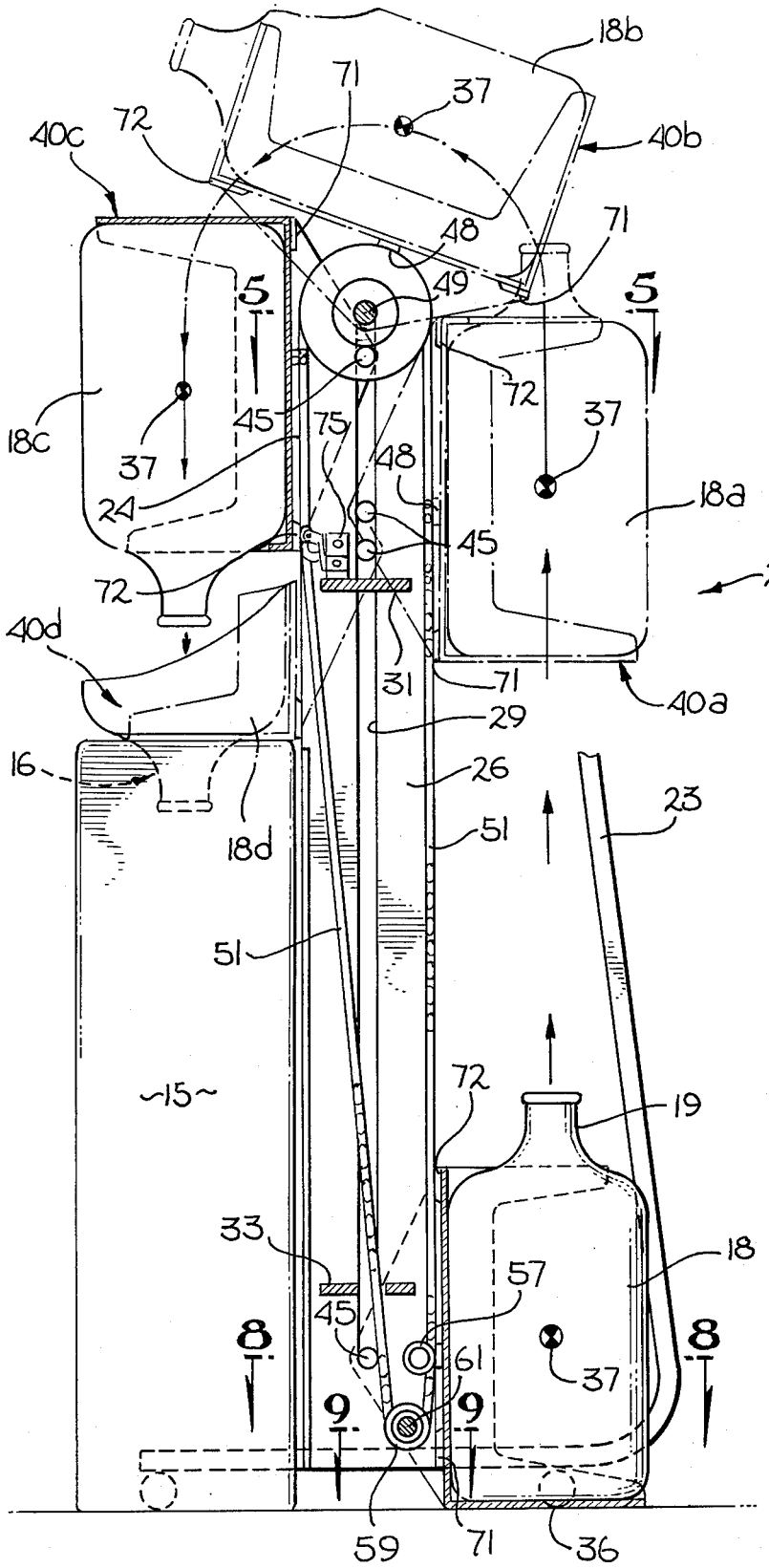
FIG. 4 is a cross-sectional side view of the water handling apparatus and water cooler of FIGS. 1, 2 and 3 taken through section line 4—4 of FIG. 3. This view is also used to illustrate the bottle carrier and bottle in various positions as the bottle is lifted, rotated and lowered into the water cooler.

DETAILED DESCRIPTION OF THE INVENTION:

An apparatus for moving a bottle (or other container) vertically in an upright position, rotating the bottle to an inverted position and moving the bottle downwardly into a water cooler, or the like, is described. The apparatus is particularly adaptable for placing a bottle of water into a water cooler, water stand, or the like, however, as will be apparent the apparatus may be used for handling other containers. The entire apparatus may be fabricated from ordinary parts, such as metal or plastic, and utilizes commercially available switches, motor and gear box. The entire apparatus may be fabricated utilizing known metal fabrication techniques or plastic fabrication techniques.

Referring first to FIGS. 1, 2 and 3, the bottle handling apparatus 20 is illustrated adjacent to a water cooler 15. The water cooler 15 includes a water spout 17 and an opening 16 for receiving the neck of a water bottle. A typical water bottle 18 is illustrated which includes a neck 19.

The apparatus includes a pair of elongated rails 25 and 26 which are mounted generally vertically, and parallel to one another. Each of the rails includes a first vertical edge 21 and a second vertical edge 24. As will be seen the bottle carrier 40 moves linearily on edges 21 of the rails 25 and 26, and after the carrier is inverted, moves linearily on the edge 24. The rails 25 and 26 are rigidly mounted spaced apart by cross members 31 and 33. The rails each define a generally vertical elongated slot disposed between its edges; specifically rail 25 defines the slot 28, while rail 26 defines slot 29 (FIG. 4). The rails and cross members may be ordinary metal parts, or plastic parts.

A pair of generally C-shaped hand grips 22 and 23 are disposed on the outer sides of the rails 25 and 26, respectively. These hand rails are rigidly attached to the rails allowing the entire apparatus 20 to be readily moved on rollers 36.

A bottle carrier 40 is mounted for movement within guide slots 28 and 29 and is adaptable for receiving a bottle such as a water bottle 18 shown in FIGS. 1, 2 and 3. Referring primarily to FIGS. 1, 2, 3, 4 and 5, the bottle carrier 40 includes a generally rectangular base plate 41, a bottle neck engaging plate 44 disposed generally parallel to, and spaced apart from, the base plate 41, and a back plate 39. A pair of generally C-shaped side plates 43 are disposed between the neck engaging plate 44 and base plate 41; these side plates may be integral with the back plate 39. The plate 44 includes a generally semi-circular cutout for receiving the top or neck region of the bottle, thus allowing the bottle to be slipped into, and out of, the carrier 40. The assembly of plates 39, 41, 43 and 44 are attached to a pair of L-shaped carriage members 46. The ends of members 46 define generally triangular ends 50 as may be best seen in FIG. 1. Disposed through each of the triangular members 50 is a pin 45 for engaging the guide slots of the rails. Guide pins 45 thus permit the carrier 40 to move vertically within the guide slots, and also to rotate about the uppermost end of the slots as is best illustrated in FIG. 4. The guide pins 45 define a pivot axis about which the carrier 40 rotates when the guide pins are in their uppermost position within the quide slots. In the presently preferred embodiment a nylon bushing is disposed about each pin 45 to allow easy movement within the slots.

A pair of idler wheels 47 and 48 are disposed for free rotation on an axle 49 at the upper end of the guide slots. Referring briefly to FIG. 6, the wheel 48 is mounted to axle 49 by bearing 54. Axle 49 is mounted by bushing 56 to rail 26. In a similar manner the other end of axle 49 is mounted to rail 25. Each of the idler wheels includes a circumferentially disposed slot for guiding a chain, such as chain 51 shown in FIG. 6 disposed about wheel 48, and chain 52 disposed about wheel 47 (FIG. 5).

In the presently preferred embodiment the driving force for the bottle carrier 40 comprises an electric motor and gear box which in turn drive a chain. Referring first to FIG. 8, a motor and gear box 65 are shown mounted to a rail 26. A pair of sprocket wheels 59 are non-rotatably mounted on opposite ends of a drive shaft 61. This drive shaft passes through motor and gear box 65, and is keyed to be driven by the gear box. One of the sprocket wheels engages the continuous chain 51, while the other engages the continuous chain 52. Referring briefly to FIG. 9 the sprocket wheel 59 is shown concentrically mounted to the driver shaft 61. The drive shaft 61 is shown rotatably mounted within the bearing 69 which bearing is mounted within rail 26.

Referring to FIG. 4, chain 51 is illustrated in position within the apparatus 20. The chain passes about the sprocket wheel 59, an idler wheel 57, the idler wheel 48 and then returns to the sprocket wheel 59. The chain 52 is disposed in a similar manner about the other sprocket wheel and idler wheels. Both chains 51 and 52 are coupled to the carriage 46 of the bottle carrier by a master link 58. This master link is best illustrated in FIG. 7. Thus, both chains 51 and 52 and the bottle carrier 40 move together.

A micro-switch 75 is rigidly mounted to the cross member 31 as may be best seen in FIGS. 4, 5, and 10. This micro-switch includes a roller 79 for engaging detents 76 and 77 disposed on the back of back plate 39. The detends 76 and 77 are spaced-apart in the vertical direction as is best seen in FIG. 10. Thus, the detend 77 first engages the roller of switch 75 (when the carrier 40 is lowering a bottle into a cooler), thereby activating switch 75. After the bottle carrier has moved a predetermined distance (downwardly), detent 76 then engages switch 74. A second micro-switch (not illustrated) is attached to cross member 33 for stopping the movement of the carrier 40 when the carrier is in its lowermost position. As will be explained these two switches interrupt the flow of electrical current to the motor thereby controlling the travel of the carrier 40. The electrical connections between these switches are not illustrated since these connections will be apparent to one skilled in the art from the explanation set forth in this application.

Referring to FIG. 4 a pair of bearing blocks 71 are mounted at the lower corners (for an upright carrier) of carriages 46 such that they engage the edges 21 of the rails.

These blocks provide a low friction surface for contacting the rails when the bottle carrier 40 is in its upright position, for example, as shown by bottle carrier 40a of FIG. 4. Blocks 71 may be fabricated from any low friction material, such as Teflon. A pair of high friction blocks 72 are disposed in the other corners of the carriage 46, that is, in the upper corners (for an upright carrier). These blocks may best be seen for the bottle **18*b* of FIG. 4, and are also visible in FIGS. 5 and 6. As will be discussed these high friction blocks engage the edges 24 of rails 25 and 26 when the carrier 40 is in an inverted position, and thereby provide a braking surface for the bottle and bottle carrier after the bottle has been rotated to the position of carrier 40c and bottle 18c of FIG. 4. The blocks 72 may be fabricated from rubber, or the like, and may be glued or otherwise bonded to the carriage 46.**

Referring to FIG. 4 the pivot axis for the carrier 40 (this axis being defined by the pins 45) is approximately horizontal with the center of gravity 37 for the carrier 40 and bottle 18 (for an upright carrier). Typically, such bottles are substantially filled, and hence the center of gravity 37 remains fixed even when the bottle is inverted. In the presently preferred embodiment, however, the pivot axis defined by the pins 45 is slightly below (approximately 0.5 inches) the center of gravity 37 (for an upright carrier). The reason for this will be explained.

Assume that a bottle is to be placed into the opening 16 of cooler 15. The entire bottle handling apparatus 20 may be rolled on rollers 36 by manually gripping the grips 22 and 23 to the storage location for the water bottles. A bottle may then be placed on the base 41 of the carrier 40 with the neck of the bottle engaging the neck engaging plate 44 of the carrier. Once the bottle is placed within the carrier the apparatus may then be rolled into engagement with a water cooler, water stand, or the like, such as is shown in FIG. 1. While for the embodiment illustrated the apparatus 20 is shown placed against the side of a cooler, as will be appreciated, the apparatus 20 may be placed in front of, or in back of the water cooler 15. A cut-out may be provided on the apparatus 20 for receiving the spout 17 where the apparatus is to be placed in front of the cooler.

Referring now to FIG. 4, in order to move the bottle 18 into position within the cooler 15 the motor and gear box 65 are activated through an ordinary electrical switching means, not illustrated. When this occurs, the chains begin to pull the carrier 40 (upwardly) since the carrier is coupled to the chains by the master links 58. In FIG. 4 the carrier 40 and bottle 18 are shown in their lower-most position, and then shown in a higher position as carrier 48a and bottle 18a. Since the center of gravity 37 is horizontally spaced-apart from the carrier pivot axis the carrier 46 tends to urge the blocks 71 against the edges of the rails, and to relieve pressure from the blocks 72. The blocks 71 reduce the friction, thus allowing the carrier to more easily slide along the edges of the rails. When the bottle carrier reaches the idler wheels it contacts these wheels and is rotated to an inverted position. Carrier 40b and bottle 18b illustrate the position of the carrier bottle during rotation. Once the center of gravity 37 of the carrier and bottle passes above the pivot axis, the weight of the carrier and bottle (and contents of the bottle) tend to cause the bottle to rotate more easily. Since the center of gravity is slightly above the pivot axis the weight of the carrier and bottle provide a force component which assists in the rotation before the carrier reaches a horizontal position. This reduces the torque requirements of the motor and gear box.

After the center of gravity 37 passes over the pivot axis the carrier and bottle tend to move downwardly more quickly. However, since the carrier is inverted the weight of the carrier and bottle urge blocks 72 against the edges 24 of the rails. The high friction surfaces of blocks 72, acting against the rail edges, reduces the rate of descent of the carrier. In one embodiment a magnetic braking means is coupled to the motor and gear box which is used to brake the movement of the carrier once power is removed from the motor and gear box.

When the detent 77 engages roller 79 of switch 75 as shown in FIGS. 4 and 10 the current to the motor and gear box 65 is interrupted by the switch causing the carrier 40c to stop its downward movement. In this position a cap on the bottle may be removed. Once the cap is removed, power is again applied to the motor and gear box 65 through a manual switch causing the carrier and bottle to continue downward to the position of bottle 18d where the neck of the bottle engages the opening of the cooler. In this position detent 76 activates switch 75 causing the motor to cease operating. The apparatus 20 may then be rolled away from the cooler 15. and through a manual switch the carrier may be returned to its original position. Through a microswitch and detent previously mentioned but not illustrated, the motor ceases to operate once the bottle carrier reaches floor level.

In the presently preferred embodiment a torque output of approximately 150 inch-pounds from the motor and gear box has been found sufficient to raise a bottle of approximately sixty pounds. A cycle time of approximately thirty seconds is used to raise the bottle from floor level into the cooler.

Figure 11:
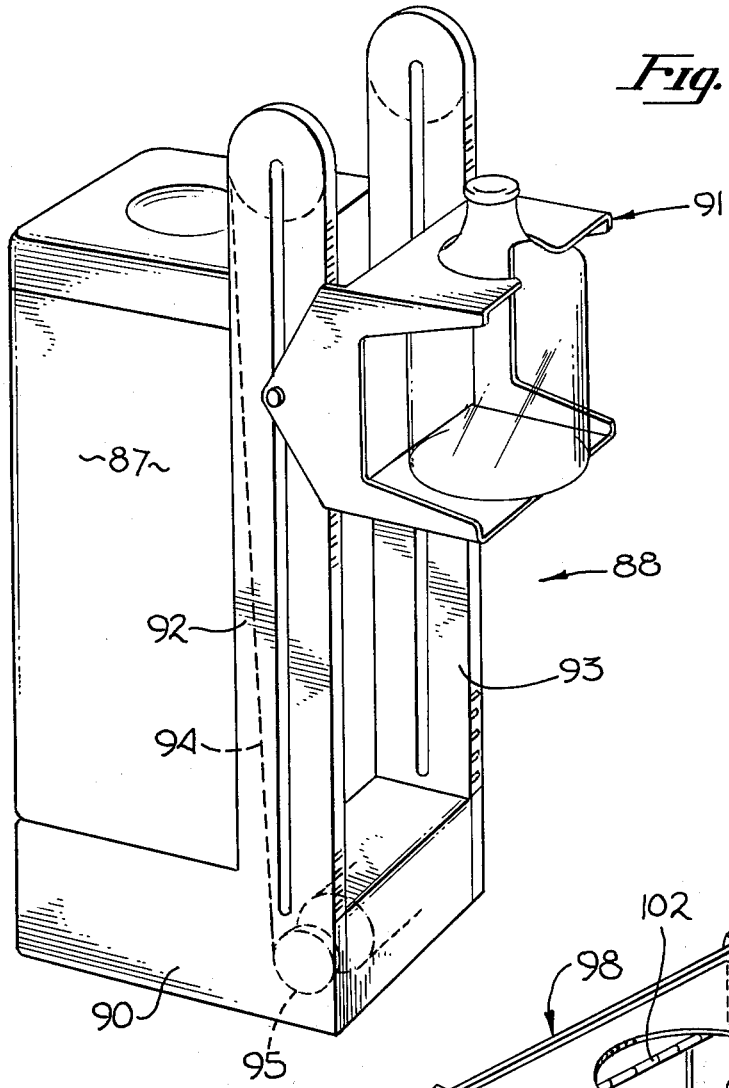
FIG. 11 is a perspective illustration of an alternate embodiment of the present invention where the water handling apparatus includes a base for a water cooler.

Referring to FIG. 11 an alternate embodiment of the present invention is illustrated and includes a bottle handler 88 which defines a base 90 for a cooler 87. Again in this embodiment a pair of rails 93 and 94 are utilized which include guide slots for engaging a bottle carrier 91. A chain 94 which is coupled to the carrier is driven by a motor 95. With this embodiment the bottle handler forms a more integral part of the cooler 87, and once the bottle has been lifted, rotated and placed within the opening of the cooler, the carrier 91 remains in place above the cooler until the bottle has been emptied. Then the carrier 91 is used to lift the empty bottle from the cooler and return it to floor level. The rails of the apparatus may be an integral part of a water cooler, water stand, or the like in an embodiment similar to that shown in FIG. 11.

Figure 12:
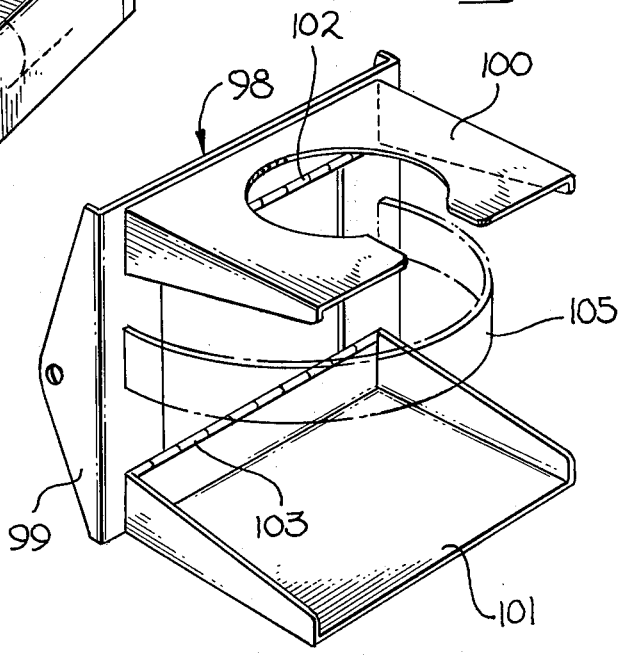
FIG. 12 is a perspective view of a callapsible water bottle carrier.
Figure 13:
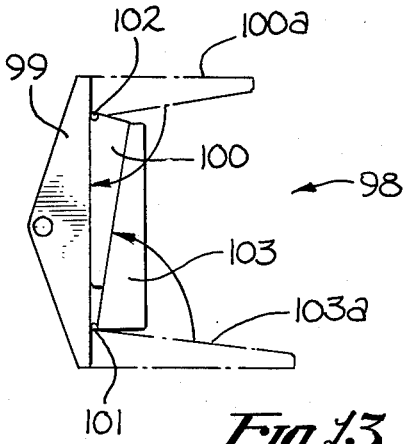
FIG. 13 is a side view of the collapsible water carrier of FIG. 12 used to illustrate the manner in which the top member and bottom member of the carrier are hinged.

Referring now to FIGS. 12 and 13 an alternate embodiment for the bottle carrier is shown. Carrier 98 includes a carriage portion 99 for engaging the guide slots of the rails in a similar manner as the previously described bottle carriers. The base plate 101 of carrier 98 is hingingly coupled, by hinge 103, to carriage 99. The bottle neck receiving plate 100 is also hingingly mounted, by hinge, 102 to the carriage 99. Referring to FIG. 13 plate 100 is shown in its extended position as plate 100a and in its folded position as plate 100. Similarly the base plate is shown in its extended position as plate 103a and in its folded position as plate 103. This embodiment is particularly useful where space must be conserved and allows the carrier to be folded when not in use.

In the carrier 98 of FIG. 12 a bottle encircling strap 105 is illustrated for securing a bottle to the carrier. This strap may be an ordinary cloth, rubber, plastic, or other member having a buckle or other fastening means for selectively securing the bottle to the carrier. Such a strap may be used with the previously described carrier 40, with the carrier 91 of FIG. 11, or with the carrier 98 of FIG. 12.

Thus a bottle handling apparatus has been described which permits a heavy water bottle to be automatically lifted from floor level, rotated and then lowered in an inverted position into a water cooler or the like. While in the presently preferred embodiment a chain drive is utilized it will be appreciated that other coupling means for coupling a driving force to the carrier may be utilized such as cables, belts, or the like. Moreover, a manual driving means may be utilized in lieu of the electrical motor and gear box. Other minor modifications to the disclosed design will be apparent to one skilled in the art.

We claim:

1. An apparatus for vertically moving a container and for rotating such container into an inverted position comprising:

at least one generally vertical rail having a first edge and a second edge, and a generally vertical guide slot disposed between said first and second edges, said guide slot having an upper end adjacent to the upper end of said rail said first and second edges and said guide slot lie in a common vertical plane, a carrier for receiving such container, said carrier including guide means for cooperatively engaging said guide slot for reciprocal movement within said guide slot and for defining a pivot axis at said upper end of said guide slot for rotation of said carrier about said upper end of said guide slot;

at least one idler wheel disposed for rotation at said upper end of said rail, said carrier engaging said idler as said carrier rotates about said upper end of said guide slot at said pivot axis;

drive means coupled to said carrier for upwardly moving said carrier along said first edge of said first rail, for rotating said carrier about said upper end of said guide slot in engagement with said idler wheel and for downwardly moving said carrier in an inverted position along said second edge of said rail;

whereby said carrier and container may be raised along said first edge of said rail, rotated to an inverted position and then lowered along said second edge of said rail.

2. The apparatus defined by claim 1 wherein said guide means is located approximately horizontally from the center of gravity of such container when said carrier is engaging said edges of said rail.

3. The apparatus defined by claim 2 wherein said drive means includes a chain drive coupled to said carrier and motor means for driving said chain.

4. A bottle handling apparatus comprising:

a pair of spaced apart, generally vertical rails, each having a first edge and a second edge, and a guide slot disposed between said first and second edges said first and second edges and said guide slot lie in a common vertical plane;

a pair of idlers disposed generally at the upper ends of said rails;

a bottle carrier for receiving a bottle, said carrier being adaptable for moving along said first and second edges of said rails and including guide means for cooperatively engaging said guide slots for movement within said guide slots and for defining a pivot axis about which said bottle carrier rotates;

braking surface included with said carrier for engaging said second edges of said rails;

drive means for moving said bottle carrier vertically within said guide slots and for rotating said carrier about said guide means and in engagement with said idlers, said drive means including a chain having a master link which is coupled to said carrier;

whereby said carrier with said bottle may be moved linearly along said first edges of said rails, rotated about said idlers, and then moved linearly along said second edges of said rails with said braking surface engaging said second edges, thereby braking the vertical movement of said carrier along said second edges.

5. The apparatus defined by claim 4 wherein the center of gravity of a bottle engaging said carrier is disposed approximately horizontally in line with said pivot axis when said carrier is engaging said edges of said rails.

6. The apparatus defined by claim 4 wherein the center of gravity of a bottle engaging said carrier when said bottle is in an upright position, is disposed on a horizontal line slightly above said pivot axis.

7. The apparatus defined by claim 4 wherein said carrier includes hinged members such that said carrier may be collapsed.

8. The apparatus defined by claim 4 including rollers for allowing said carrier to be rolled.

9. The apparatus defined in claim 4 wherein said apparatus defines a base for receiving a water cooler or the like.

10. An apparatus for for raising a bottle of water, rotating said bottle of water and then lowering said bottle of water in an inverted position comprising:

a base;

a pair of vertical parallel rails each having a first and second edge, said rails being spaced apart on said base, each of said rails defining a generally vertical guide slot disposed between said first and second edges, each of said guide slots having an upper end adjacent to an upper end of one of said rails;

a bottle carrier for receiving a bottle, said carrier including a pair of guide pins, each of said guide pins for cooperatively engaging one of said guide slots for reciprocal movement within said guide slots, said guide pins defining a pivot axis at said upper end of said guide slots for rotation of said carrier about said upper ends of said guide slots;

a pair of idler wheels, said wheels being mounted for rotation on said spaced apart rails at said upper ends of said rails, said carrier engaging said idlers as said carrier rotates about said upper ends of said guide slots;

motor means;

chain drive means coupled to said motor means and said bottle carrier and disposed about at least one of said idler wheels for moving said carrier along said first edges of said rails, rotating said carrier about said axis defined by said guide pins while said carrier is in engagement with said idler wheels and for moving said carrier in an inverted position against said second edges of said rails;

whereby a bottle may be linearly moved along said first edges of said rails, rotated to an inverted position, and linearly moved along said second edges of said rails.

11. The apparatus defined in claim 10 including a first electrical switch means for stopping the movement of said carrier in a pre-determined inverted position.

* * * * *